US005194034A

United States Patent [19]

Heppenstall

[11] Patent Number: 5,194,034

[45] Date of Patent: Mar. 16, 1993

[54] STRETCHABLE BODYSUIT FOR PRESERVING AND PROTECTING DOLLS

[76] Inventor: Lucy Heppenstall, 480 S. Marion Pkwy., No. 705, Denver, Colo. 80209

[21] Appl. No.: 732,666

[22] Filed: Jul. 19, 1991

[51] Int. Cl.[5] ..... A63H 3/02; A63H 3/00; A63H 3/46

[52] U.S. Cl. ..... 446/369; 446/73; 446/268; 446/380; 2/80

[58] Field of Search ..... 446/72, 73, 98, 268, 446/296, 369, 371, 376, 378, 379, 380, 382, 383; 2/69, 75, 80

[56] References Cited

U.S. PATENT DOCUMENTS

| | | | |
|---|---|---|---|
| 1,437,467 | 12/1922 | Dykman | 446/14 |
| 1,485,638 | 4/1924 | Smith | 446/369 |
| 1,690,778 | 11/1928 | Ford | 446/369 |
| 2,540,701 | 2/1951 | Thorpe | 446/369 |
| 2,636,318 | 4/1953 | Lock | 446/369 |
| 2,942,273 | 6/1960 | Lusk | 2/80 |
| 3,436,762 | 4/1969 | Cahan | 2/67 |
| 4,304,006 | 12/1981 | Swart | 2/80 X |
| 4,343,044 | 8/1982 | Borda et al. | 2/67 |
| 4,371,989 | 2/1983 | Polsky | 2/407 X |
| 4,627,111 | 12/1986 | Storie | 2/69 |
| 4,865,097 | 9/1989 | Allen | 150/154 |
| 5,067,924 | 11/1991 | Munter | 446/296 X |

FOREIGN PATENT DOCUMENTS

| | | | |
|---|---|---|---|
| 179263 | 4/1922 | United Kingdom | 446/371 |

*Primary Examiner*—D. Neal Muir
*Attorney, Agent, or Firm*—John E. Reilly

[57] ABSTRACT

Dools, and particularly modern and composition dolls, can be restored and strengthened with a protective body covering in the form of an undergarment of stretchable material and which includes a torso covering with a neck opening, short sleeves and leg covers and a separable closure to permit the doll to be inserted in snug-fitting relation into the garment so that the material of a garment is stretched around the limbs of the doll to better unite the limbs to the torso.

11 Claims, 2 Drawing Sheets

STRETCHABLE BODYSUIT FOR PRESERVING AND PROTECTING DOLLS

This invention relates to dolls; and more particularly relates to a protective body covering for dolls which will operate to strengthen and preserve dolls so as to greatly extend their life and appearance.

BACKGROUND AND FIELD OF THE INVENTION

Currently, dolls are the number one collectable item in the United States. Of the more valuable dolls, there is the composition doll which is made up of a muslin body, and the head and limbs are composed of a pressed sawdust material. Another type of doll is the modern doll in which the torso is a cloth material and the head and limbs are made out of a vinyl or soft plastic material. The present invention may be best typified by describing its use in connection with composition and modern dolls, although it will become readily apparent that it has useful application to other types of dolls and especially the collectable dolls. A particular problem associated with the composition of modern dolls as well as others having a soft body is that they tend to become discolored or stained so as to require professional renovation or repair. Also, the arms and legs often become detached from the body or torso and this is especially true of those which are attached by awling, wire or coil screws at the joints. A related problem with both types of dolls is the difficulty of maintaining the dolls in a particular attitude, for instance, in a standing or sitting position.

Body coverings have been devised in the past for dolls but in general do not overcome the problems enumerated particularly with respect to the ability to preserve and strengthen the doll without requiring extensive repair. For example, U.S. Pat. No. 2,540,701 to M. A. Thorpe discloses a knitted, one-piece garment which substantially encloses the entire outer surface of the doll except for the outer tips of the arms and head. U.S. Pat. No. 2,636,318 to D. F. Lock is directed to a washable doll cover having a tubular body portion which is sleeveless but provided with a head on its upper end and joined together with a separable fastener, and separate leg and arm coverings are provided. U.S. Pat. No. 4,865,097 to P. L. Allen discloses an antique doll protective system which is in the form of a padded member wrapped around the doll and not intended to be worn as an undergarment. U.S. Pat. No. 1,485,638 to E. L. Smith also discloses a stocking-type one-piece cover, and U.S. Pat. No. 1,690,778 to G. C. Ford discloses a full body covering for a doll.

It has been proposed in the past to employ four-way stretch materials, such as, Lycra in the design and construction of bodywear for humans and specifically for swimwear as typified by U.S. Pat. Nos. 3,436,762 to L. C. Cahan and 4,343,044 to W. Borda et al. To the best of my knowledge, however, no one has utilized a four-way stretch material as a body covering for dolls and in such a manner that the body cover can be stretched over the torso of the doll as well as portions of the limbs so as to unitize and strengthen the joints while acting as a protective undergarment which will not detract from the other clothing that is worn by the doll; nor has anyone proposed or utilized a body covering as a retrofit attachment for existing dolls not only to preserve and strengthen them but to enhance their overall appearance and avoid extensive maintenance and repair.

SUMMARY OF THE INVENTION

It is therefore an object of the present invention to provide for a novel and improved body covering for preserving and protecting dolls.

Another object of the present invention is to provide for a novel and improved body covering which can serve as an undergarment for dolls and which is washable and will unitize and reinforce the joints between the limbs and torso of the doll and in such a way as to minimize costly repairs.

It is another object of the present invention to provide for a novel and improved undergarment for dolls which can be manufactured at a low cost and easily placed on and removed from a doll without damaging the doll itself; and specifically wherein the garment will minimize any tendency of the torso to break down in the crotch area and, when worn, will permit the doll to assume different standing and sitting positions and attitudes for the purpose of display.

In accordance with the present invention, a novel and improved body covering for dolls of the type having a torso, head, arms and legs with articulated arm and leg joints at their connection to the torso, the body covering comprising a torso-covering portion open at one end and having a crotch area at its opposite end, sleeves extending from opposite sides of the torso-covering portion and leg covers extending from the opposite end and flanking the crotch area, separable closure means extending from the one end through which the doll is inserted with the legs extending through the leg covers and the arms extending through the sleeve, the body covering being stretchable for snugfitting insertion of the doll therein whereby to stretch the material when the doll is inserted into the body covering and the closure means is closed.

In the preferred form of body covering, the material is a four-way stretch material, such as, cotton Lycra, and the sleeves are short sleeves extending just beyond the arm joints and in snug-fitting relation to the arms, and the leg covers are of a length to extend just beyond the leg joints in snugfitting relation to the legs of the doll. Darts are formed at spaced intervals particularly along the buttocks area of the torso-covering portion so that when worn the doll is better able to assume different positions or attitudes for the purpose of display.

Other objects, advantages and features of the present invention will become more readily appreciated and understood when taken together with the following detailed description of a preferred embodiment in conjunction with the accompanying drawings, in which:

DETAILED DESCRIPTION OF PREFERRED EMBODIMENT

Figure 1:
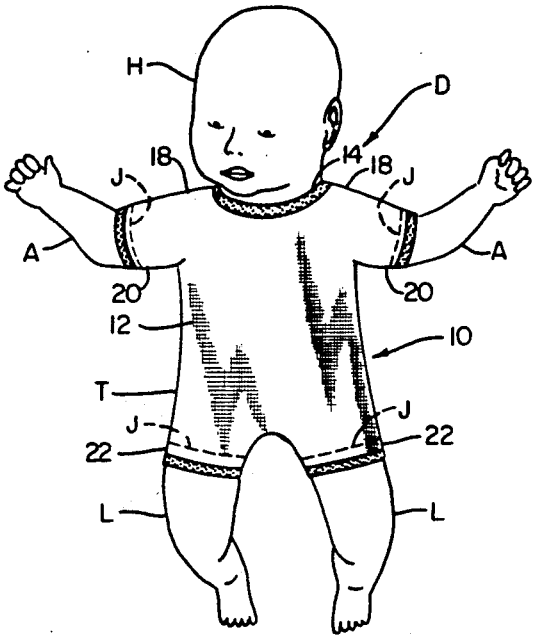
FIG. 1 is a front view illustrating a preferred form of body covering on a doll.

Referring in detail to the drawings, there is illustrated in FIGS. 1 to 6 a preferred form of body covering 10 for a doll as represented at D. For the purpose of illustration and as a setting for the present invention, the doll D is a modern doll having a cloth covering and including a vinyl head H, arms A and legs L with feet F. In the modern doll, typically the interconnection of the limbs to the torso T is by means of awled joints J having little reinforcing of their own so that the arms and legs are relatively free to swing or flop around the torso as represented at T. The limbs of the doll are typically made of a vinyl or other soft plastic material and tend to become detached from the torso or trunk T of the doll; also, the cloth torso portion becomes stained or disfigured over time.

In order to preserve the doll while at the same time strengthening it, the preferred form of bodysuit 10 is comprised of a torso-covering portion 12 which is open at one end to define a neck opening 14 and closed at the opposite lower end to define a crotch area 16. The upper open end of the torso has shoulders 18 which extend away from the neck area 14 and terminate in arm openings which are preferably in the form of short sleeves 20 for insertion of the arms A of the doll.

Figure 2:
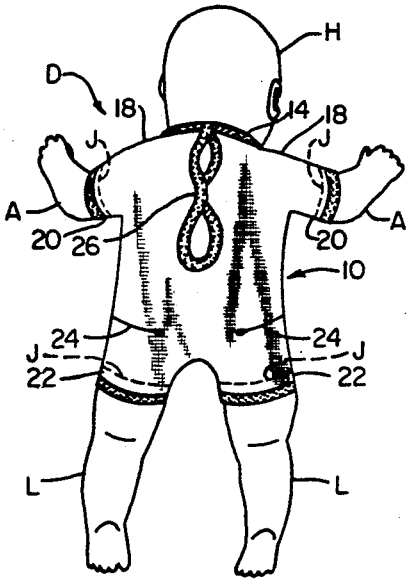
FIG. 2 is a rear view of the preferred form of body covering shown in FIG. 1.
Figure 3:
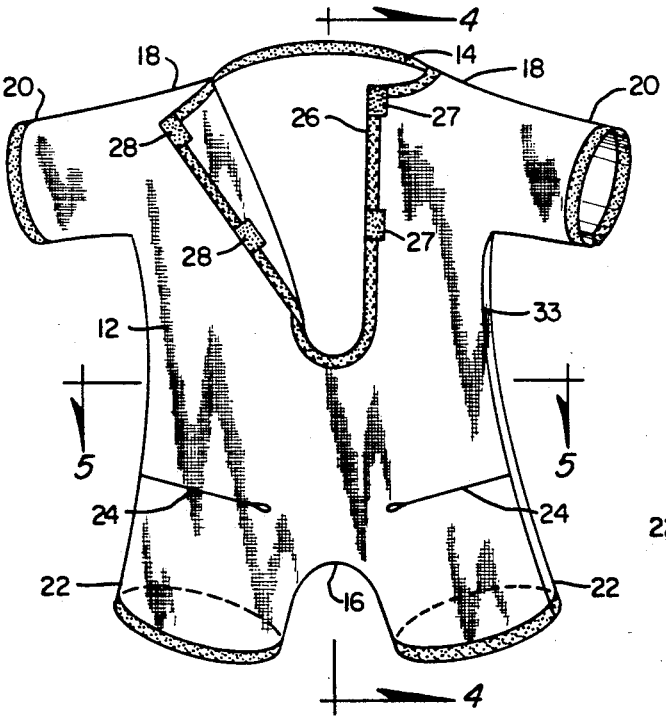
FIG. 3 is an enlarged rear view in more detail of the preferred form of body covering.
Figure 4:
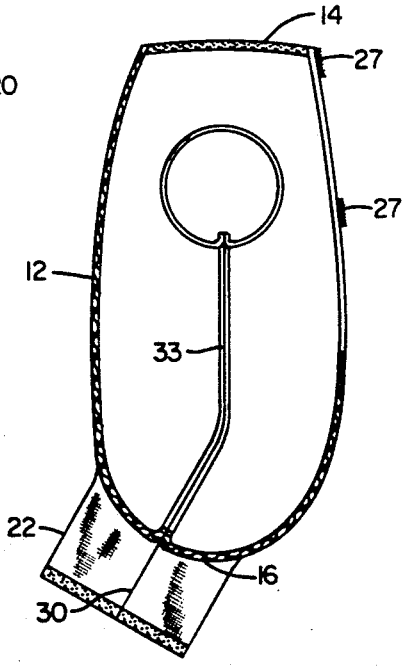
FIG. 4 is a cross-sectional view taken about lines 4—4 of FIG. 3.

Lower leg openings are preferably in the form of short leg covers 22 which flank the crotch area 16 to permit insertion of the feet and legs L of the doll with the leg covers extending less than midway down the thigh portions of the legs. Darts 24 slant across the lower, rear region of the torso-covering portion 12, as illustrated in FIGS. 2 and 3 for a purpose to be described. Moreover, the upper rear section of the torso-covering portion 12 is divided to form a vertical split 26 which extends downwardly from the upper neck area 14 to permit opening and expansion of the upper end of the bodysuit for insertion of the doll. The split portion forms part of a separable closure with mating halves or complementary Velcro strips 27 and 28 at vertically spaced intervals along the split edges or seams 26 to releasably close the upper end of the torso-covering portion so as to snugly fit around the upper torso of the doll.

Figure 6:
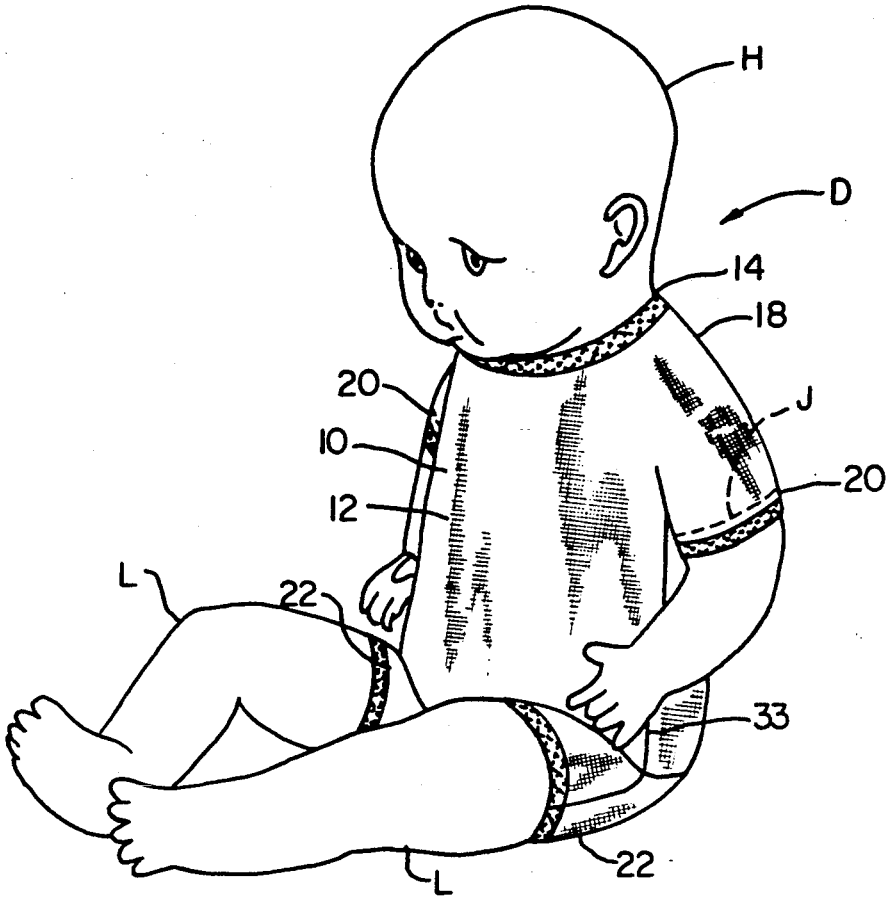
FIG. 6 is a perspective view of the preferred form of body covering which will permit the doll to assume a sitting position.
Figure 5:
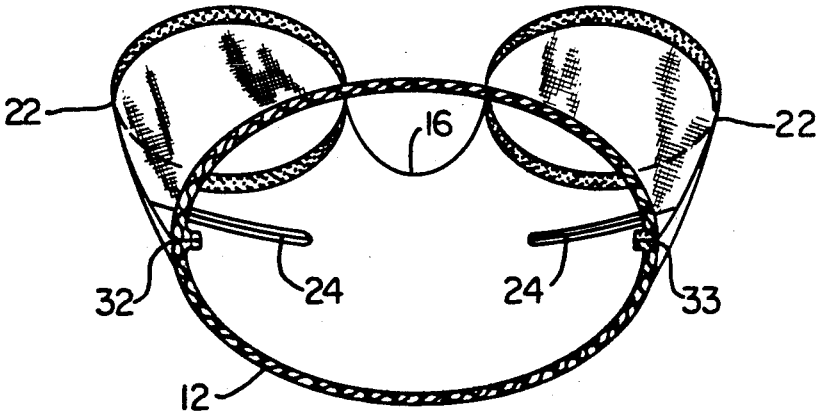
FIG. 5 is a cross-sectional view taken about lines 5—5 of FIG. 3.

Various approaches have been taken in the precise seaming and construction of the bodysuit. For the purpose of illustration but not limitation, the bodysuit is a one-piece garment having an inseam 30 along the crotch area 16, and outer seams 32 and 33 along opposite sides of the torso-covering portion. In addition, the neck area 14 as well as the sleeves 20 and leg coverings 22 and seams 26 are surged as shown along their hems. Most importantly, the body covering 10 is composed of a four-way stretch material and preferably a 90/10 cotton Lycra knit material. The covering 10 is further dimensioned so as to be slightly undersized with respect to each respective doll size so that when placed on the doll will be stretched and thereby yieldingly compressed around the torso and limbs of the doll. As a result, the body covering 10 will operate to reinforce the doll particularly along the joints represented in dotted form at J in FIGS. 1 and 2. The darts in turn define gathers in the bodysuit which will permit a limited degree of stretching of the legs L, for example, if it is desired to having the doll assume a sitting position as illustrated in FIG. 6.

From the foregoing, modifications may be made in the sleeve and leg cover length according to the particular location of the joints J between the limbs and torso, it being the principal function of the sleeves 20 and leg covers 22 to extend just beyond the joints and effectively unite the limbs to the torso. This is especially true where the joints have become partially torn or detached.

It is therefore to be understood that while a preferred form of invention has been herein set forth and described, various other modifications and changes may be made without departing from the spirit and scope of the invention as defined by the appended claims and reasonable equivalents thereof.

I claim:

1. A body covering combination with a doll of the type having a torso, head, arms and legs, said arms and legs having arm and leg joints, respectively at their connection to said torso, said covering comprising:

a torso-covering portion open at one end and having a crotch area at its opposite end, sleeves extending from opposite sides of said torso-covering portion and leg covers extending from said opposite end and flanking said crotch area, separable closure means extending from said one end through which said doll is inserted with said legs extending through said leg covers and said arms extending through said sleeves, said sleeves and said leg covers each defining retention means for engaging said arms and legs, respectively, whereby to retain said arms and legs in unitary relation to said torso; and said covering composed of a four-way stretch material, said covering dimensioned for snugfitting insertion of said doll whereby to stretch said material when said doll is inserted into said covering and said separable closure means is closed.

2. A body covering according to claim 1, said sleeves being short sleeves extending just beyond said arm joints and in snugfitting relation to said arms.

3. A body covering according to claim 1, said leg covers being of a length to extend just beyond said leg joints in snugfitting relation to said legs.

4. A body covering according to claim 1, said material being a cotton elastomeric material.

5. A body covering according to claim 4, said material being a 90/10 cotton elastomeric knit material.

6. A body covering according to claim 1, said covering having darts at spaced intervals in a lower region of said torso-covering portion.

7. In a doll having a torso composed of a muslin or cloth material and provided with joints for connection of arms and legs to said torso, the combination therewith comprising:

a one-piece bodysuit including a torso and buttocks covering with an upper head opening and a lower crotch area, short sleeves on opposite sides of said torso covering and short leg covers flanking said crotch area, said suit provided with releasable closure means for insertion of said doll such that said legs extend through said leg covers and said arms extend through said sleeves; and said sleeves and said leg covers defining retention means for engaging said arms and said legs, respectively, whereby to retain said arms and said legs in unitary relation to said torso.

8. In a doll according to claim 7, said retention means composed of a four-way stretch material incorporated into said bodysuit.

9. In a doll according to claim 7, said bodysuit formed entirely of a cotton elastomeric material and having darts in the buttocks covering area.

10. In a doll according to claim 7, said releasable closure means defined by a vertical split portion extending downwardly from said upper head opening, and complementary hook and loop type fasteners along opposite edges of said vertical split portion.

11. In a doll according to claim 7, said sleeves and said leg covers extending just beyond said joints.

* * * * *